US008444137B2

(12) United States Patent
Hirajima

(10) Patent No.: US 8,444,137 B2
(45) Date of Patent: May 21, 2013

(54) RECORDING MATERIAL FEEDING APPARATUS AND IMAGE FORMING APPARATUS

(75) Inventor: Marehiko Hirajima, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/288,301

(22) Filed: Nov. 3, 2011

(65) Prior Publication Data

US 2012/0112407 A1 May 10, 2012

(30) Foreign Application Priority Data

Nov. 4, 2010 (JP) ..... 2010-247860

(51) Int. Cl.
*B65H 1/08* (2006.01)

(52) U.S. Cl.
USPC ..... 271/30.1; 271/126; 271/128; 271/147; 271/152

(58) Field of Classification Search
USPC ..... 271/30.1, 126, 127, 128, 147, 152
See application file for complete search history.

(56) References Cited

U.S. PATENT DOCUMENTS

| | | | | |
|---|---|---|---|---|
| 2006/0071402 | A1* | 4/2006 | Takasaka et al. | 271/126 |
| 2010/0074637 | A1* | 3/2010 | Shiraishi | 399/23 |
| 2010/0225049 | A1* | 9/2010 | Dyer et al. | 271/126 |
| 2011/0187047 | A1* | 8/2011 | Ichikawa et al. | 271/127 |

FOREIGN PATENT DOCUMENTS

| | | | |
|---|---|---|---|
| JP | 10-310285 | A | 11/1998 |
| JP | 2000-153936 | A | 6/2000 |
| JP | 2005-231887 | A | 9/2005 |

* cited by examiner

*Primary Examiner* — David H Bollinger
(74) *Attorney, Agent, or Firm* — Canon USA Inc. IP Division

(57) ABSTRACT

In a sheet feeding cassette which lifts up and lifts down a bottom plate each time when a paper is fed, a recording material sensor detects that no recording materials exist when the bottom plate rises over a predetermined position. Accordingly, by measuring a period of time when it is detected that no recording materials exist during a sheet feeding operation, a stacking amount of the recording materials in a sheet feeding cassette can be detected.

10 Claims, 8 Drawing Sheets

RECORDING MATERIAL FEEDING APPARATUS AND IMAGE FORMING APPARATUS

BACKGROUND OF THE INVENTION

1. Field of the Invention

The present invention relates to a recording material feeding apparatus configured to detect a remaining amount of recording materials on a stacking unit, and an image forming apparatus.

2. Description of the Related Art

Conventionally, as a stacker portion holding recording materials on which an image is to be formed, for example, a sheet cassette or a sheet feed deck is provided in an image forming apparatus. For the stacker portion, a configuration including a plurality of sensors for detecting whether recording materials exist and a stacking amount thereof has been known.

Japanese Patent Application Laid-Open No. 2000-153936 discusses a technique for detecting whether or not recording materials exist in the stacker portion using an optical sensor and a flag with different transmittances.

Although the detection sensor can detect whether the recording materials exist and the stacking amount thereof by only one sensor using a flag with different transmittances as discussed in the Japanese Patent Application Laid-Open No. 2000-153936, it is difficult to detect a difference in transmittance of the flag accurately. Further, producing such a flag having a plurality of transmittances leads to increase in cost.

SUMMARY OF THE INVENTION

In views of a circumstance mentioned above, the present invention is directed to detecting whether recording materials exist and a stacking amount of the recording materials accurately without using a flag having a plurality of different transmittances.

According to an aspect of the present invention, a recording material feeding apparatus comprising: a feeding unit configured to feed a recording material; a stacking unit in which recording materials are stacked on a stacker portion thereof, the stacking unit lifting up the stacker portion to feed the recording material using the feeding unit and lifting down the stacker portion; a detection unit configured to detect the position of the stacker portion; and a control unit configured to acquire a stacking amount of the recording materials stacked on the stacker portion based on a result of detection made by the detection unit in a period of time when the stacker portion is lifted up from a lifted-down state thereof to feed the recording material and the stacker portion is lifted down from the lifted-up state.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Following exemplary embodiments do not restrict the present invention stated in claims, and not all combinations of features described in the exemplary embodiments are indispensable for the present invention.

Figure 1:
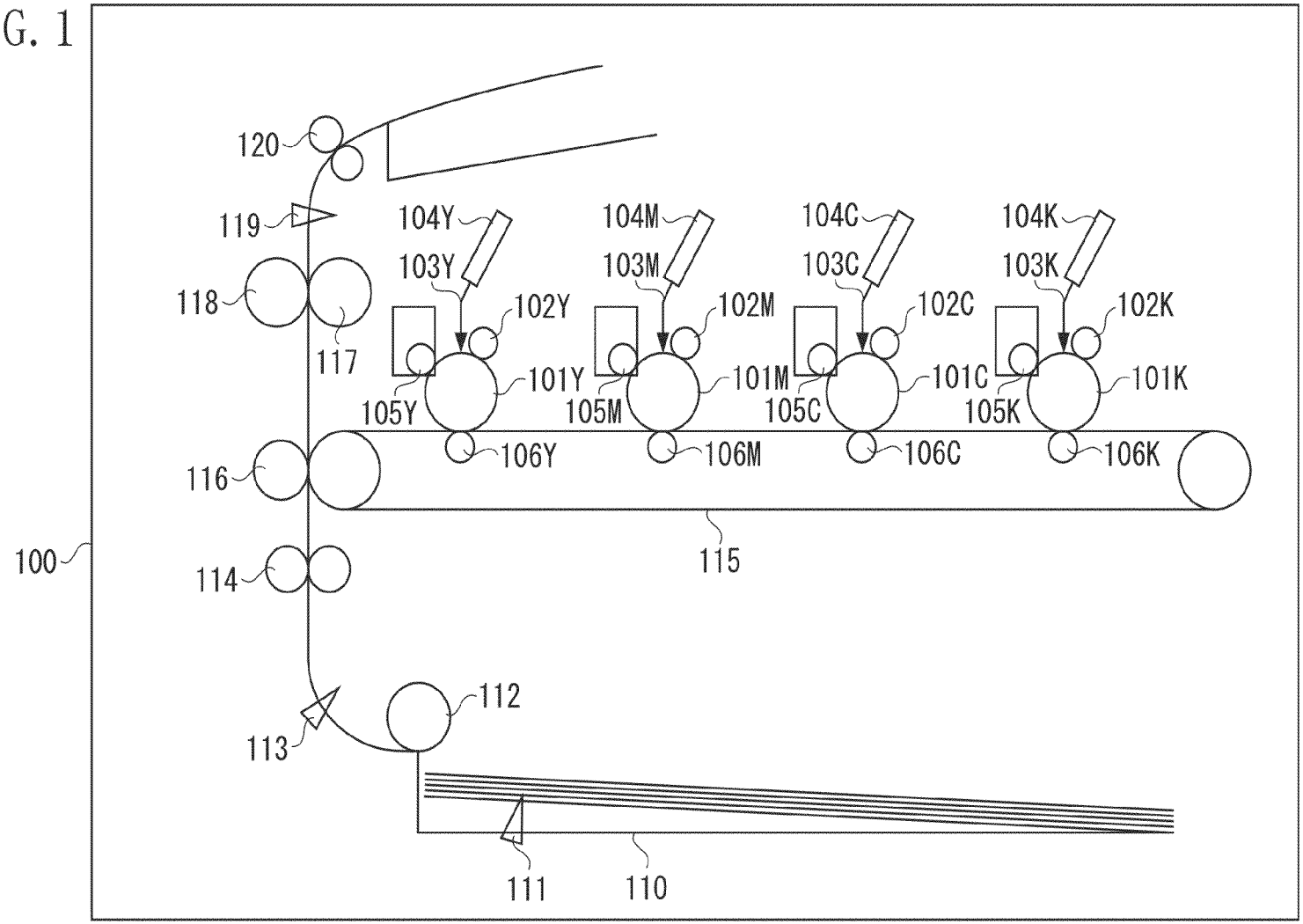
FIG. 1 is a schematic configuration diagram of an image forming apparatus 100.

FIG. 1 is a schematic configuration diagram of an image forming apparatus. Hereinbelow, the image forming apparatus 100 will be described in detail.

The configuration of the image forming apparatus is as follows. Photosensitive drums 101Y, 101M, 101C, 101K carry developers for yellow, magenta, cyan and black. Charging rollers 102Y, 102M, 102C, 102K serve as primary charging units for the respective colors, which charge the photosensitive drums 101Y, 101M, 101C, 101K respectively with a predetermined uniform potential.

Laser beams 103Y, 103M, 103C, 103K correspond respectively to image data of the respective colors on the photosensitive drums 101Y, 101M, 101C, 101K charged by the primary charging units. Optical units 104Y, 104M, 104C, 104K is used to form electrostatic latent images.

Developing units 105Y, 105M, 105C, and 105K visualize the electrostatic latent images formed on the photosensitive drums 101Y, 101M, 101C, 101K. Primary transfer rollers 106Y, 106M, 106C, 106K for the respective colors primarily transfer the images formed on the photosensitive drums 101Y, 101M, 101C, 101K. An intermediate transfer belt 115 carries primarily transferred images.

A sheet feeding cassette 110 holds papers as the recording material, a recording material sensor 111 detects whether or not any recording material exists in the sheet feeding cassette 111, and a sheet feeding roller 112 feeds a sheet of the recording materials from those stacked in the sheet feeding cassette 110.

A registration roller 114 carries the recording material and is synchronized with an image formed on the intermediate transfer belt 115. A registration sensor 113 detects a recording material carried between the sheet feeding roller 112 and the registration roller 114.

A secondary transfer roller 116 transfers an image formed on the intermediate transfer belt 115 onto the recording material. A fixing roller 117 fixes an unfixed image to the recording material after the image is transferred onto the recording material. A pressing roller 118 fixes the unfixed image to the recording material after the image is transferred to the recording material together with the fixing roller 117.

A sheet discharge sensor 119 detects whether or not any recording material having a fixed image exists. A discharge roller 120 discharges the recording material.

Next, an image forming operation of the image forming apparatus 100 will be described. Print data including a print command and image information is input to the image forming apparatus 100 from a host computer (not illustrated). Then, the image forming apparatus 100 starts a print operation, so that the recording material is fed to a conveyance path from the sheet feeding cassette 110 by the sheet feeding roller 112.

To ensure a synchronization between the image forming operation for forming an image on the intermediate transfer belt 115 and a timing for conveying the recording material, the recording material is stopped temporarily at the registration roller 114 and waits until the image formation starts.

As an image forming operation together with an operation of feeding the recording material, the photosensitive drums 101Y, 101M, 101C, 101K are charged at a predetermined potential by the charging rollers 102Y, 102M, 102C, 102K.

Corresponding to the input print data, the optical units 104Y, 104M, 104C, 104K scan the surfaces of the charged photosensitive drums 101Y, 101M, 101C, 101K with the laser beams 103Y, 103M, 103C, 103K to form an electrostatic latent image.

The formed electrostatic latent image is developed by the developing units 105Y, 105M, 105C, 105K so that those latent images are visualized. The electrostatic latent images formed on the surfaces of the photosensitive drums 101Y, 101M, 101C, 101K are developed as images of respective colors by the developing units 105Y, 105M, 105C, and 105K.

The photosensitive drums 101Y, 101M, 101C, 101K keep contact with the intermediate transfer belt 115 and is rotated in synchronization with a rotation of the intermediate transfer belt 115. Each developed image is transferred onto the intermediate transfer belt 115 successively by the primary transfer rollers 106Y, 106M, 106C, 106K so that the respective images overlap. Then, the overlapped images are transferred onto a recording material by the secondary transfer roller 116.

After that, the recording material is conveyed to a secondary transfer unit to execute the secondary transfer onto the recording material in synchronization with the image forming operation. The image formed on the intermediate transfer belt 115 is transferred onto the recording material by the secondary transfer roller 116.

After transferred onto the recording material, the image is fixed thereto by the fixing roller 117 and the pressing roller 118. After the image is fixed, the recording material is discharged onto a sheet discharge tray by the discharge roller 120 and then, the image forming operation is terminated.

Figure 2:
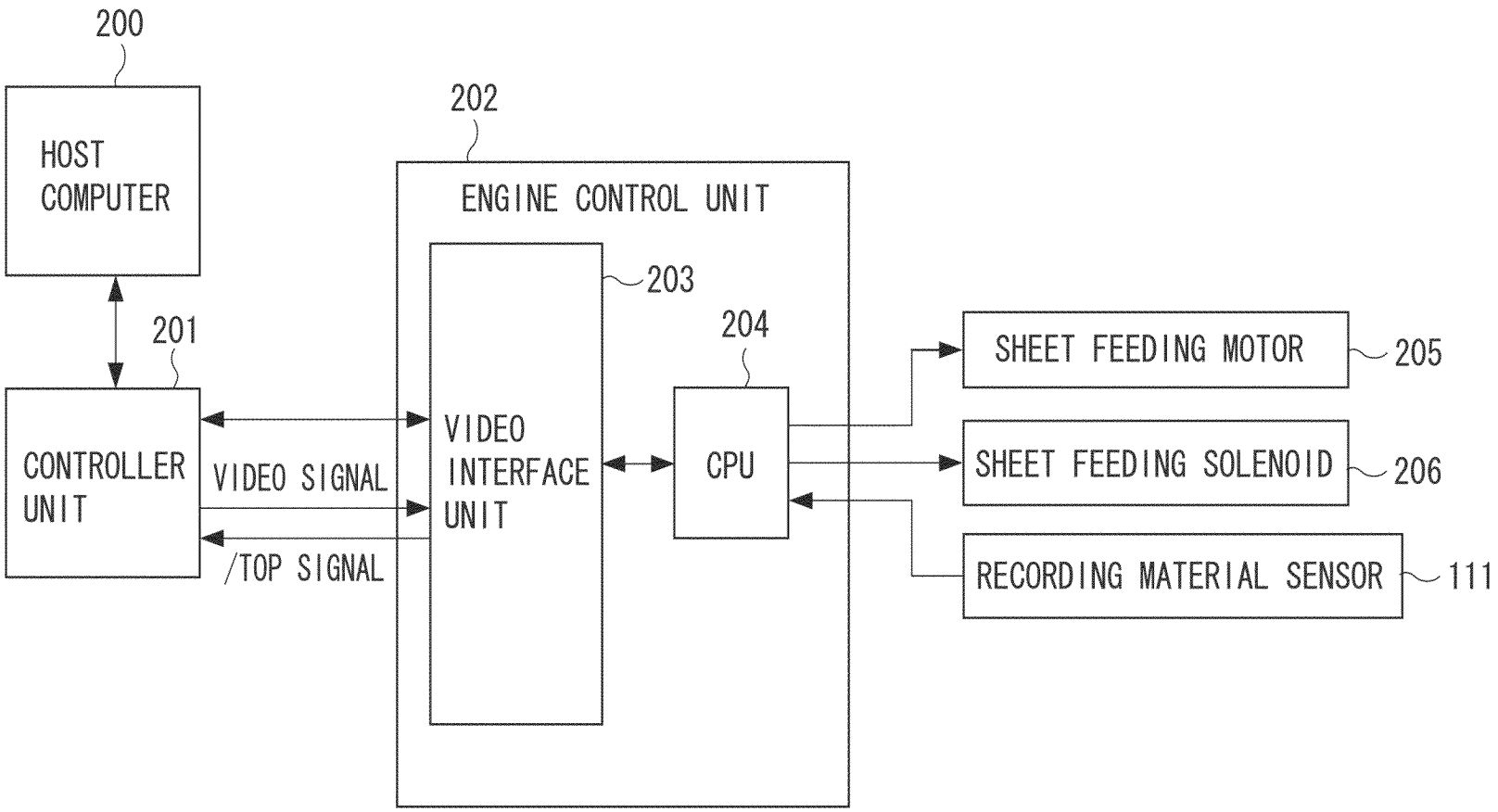
FIG. 2 is a block diagram illustrating an engine control unit of the image forming apparatus 100.

FIG. 2 is a block diagram illustrating an engine control unit of the image forming apparatus 100.

A host computer 200 sends image information and print command to a controller unit 201. The controller unit 201 analyzes the image information received from the host computer 200, and sends the analysis result to a video interface unit 203.

The controller unit 201 can communicate with the host computer 200 and the engine control unit 202. The controller unit 201 sends a print reservation command, a print start command, and a video signal to the engine control unit 202 through the video interface unit 203.

When the engine control unit 202 receives a print reservation command from the controller unit 201 via the video interface unit 203, the engine control unit 202 performs control to prepare for printing according to an order of the print reservation commands by means of the CPU 204, and waits for receiving a print start command.

When receiving the print start command, the engine control unit 202 outputs a /TOP signal which acts as a reference timing for outputting a video signal to the controller unit 201, and starts a print operation according to the print reservation command.

When performing the print operation, the CPU 204 controls the sheet feeding motor 205 for driving the sheet feeding roller 112, and the sheet feeding solenoid 206 for starting a rotation control of the sheet feeding roller 112. The CPU 204 determines whether or not any recording material is loaded on the sheet feeding cassette 110 based on an output value of the recording material sensor 111 for detecting the existence of the recording material.

Figure 3A:
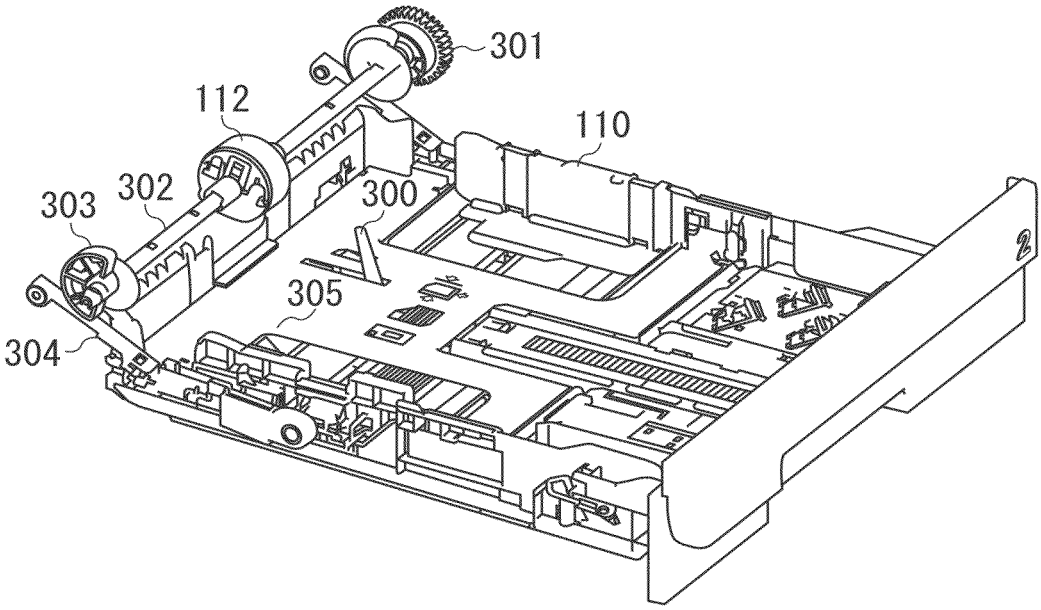
FIGS. 3A and 3B are schematic configuration diagrams illustrating a sheet cassette 110.
Figure 3B:
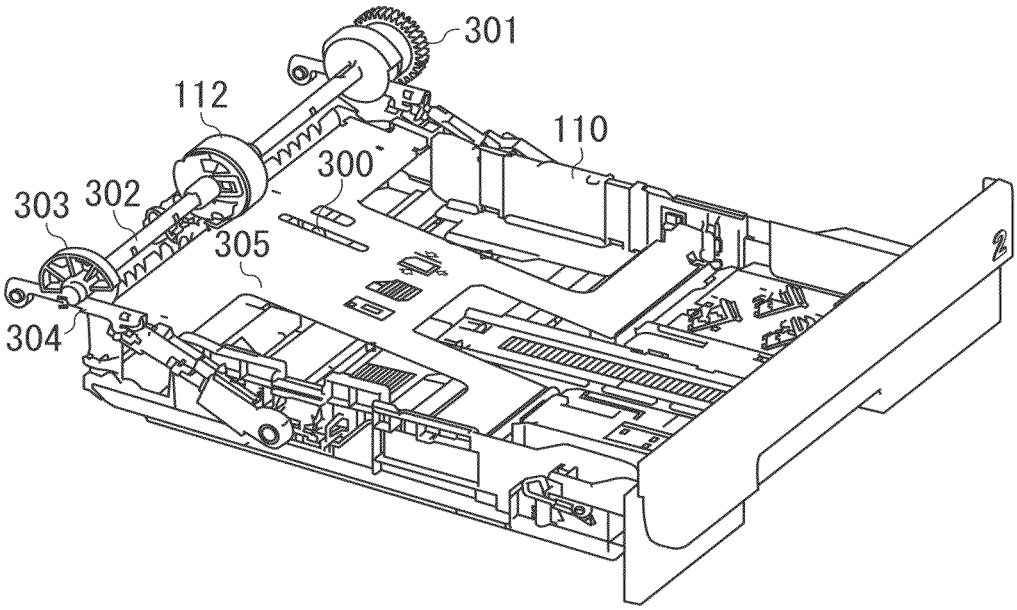

FIGS. 3A and 3B are schematic configuration diagrams illustrating the sheet cassette 110 which functions as a recording material feeding apparatus. FIG. 3A illustrates a home position to which the sheet cassette is lowered prior to the sheet feeding operation. FIG. 3B illustrates a status in which the sheet cassette is raised during the sheet feeding operation.

The sheet cassette 110 feeds the recording material by lifting up or lifting down a bottom plate 305 on which the recording materials are stacked. In the meantime, the lift-up and lift-down operations are executed each time when the recording material is fed.

The structure of the sheet cassette 110 will be described in detail. As illustrated in FIG. 1, the sheet feeding roller 112 is disposed at an end portion on the conveyance path side of the sheet cassette 110. The sheet feeding roller 112 is coupled with a toothless gear 301 via a sheet feeding roller shaft 302.

When the sheet feeding solenoid 206 is turned ON, a driving power of the sheet feeding motor 205 is transmitted to rotate the toothless gear 301. The sheet feeding roller 112 is rotated interlocking with a rotation of the toothless gear 301.

The recording material sensor 111 has a recording material sensor lever 300, and FIGS. 3A and 3B illustrate a status in which no recording material is stacked on the bottom plate 305. The recording material sensor 111 can detect whether or not any recording materials are loaded depending on whether or not the recording material sensor lever 300 is fallen by the recording materials.

A sheet feeding cam 303 presses down an intermediate plate elevating lever 304, which is pressurized by a spring, when it is located at home position prior to the sheet feeding operation as illustrated in FIG. 3A. When the intermediate plate elevating lever 304 is pressed down, the bottom plate 305 is lowered to the same position as a bottom surface of the sheet cassette 110.

The sheet feeding cam 303 is coupled with the sheet feeding roller shaft 302, so that the sheet feeding cam 303 makes a rotation interlocking with one rotation of the sheet feeding roller shaft 302 during the sheet feeding operation. The sheet feeding cam 303 is in a crescentic shape, and while the sheet feeding cam 303 makes a rotation, the press-down amount of the intermediate plate elevating lever 304 is decreased and then increased again.

When the pressing-down amount of the intermediate plate elevating lever 304 is decreased, the intermediate plate elevating lever 304, which is pressurized by the spring, is raised. As illustrated in FIG. 3B, when the intermediate plate elevating lever 304 is raised, the bottom plate 305 is raised interlockingly and butts against the sheet feeding roller 112.

When the sheet feeding cam 303 continues to rotate further, the pressing-down amount of the intermediate plate elevating lever 304 is increased and consequently, the intermediate plate elevating lever 304 pressurized by the spring is lowered. Interlocking with the lowering of the intermediate plate elevating lever 304, the bottom plate 305 is lowered to its home position.

Figure 4A:
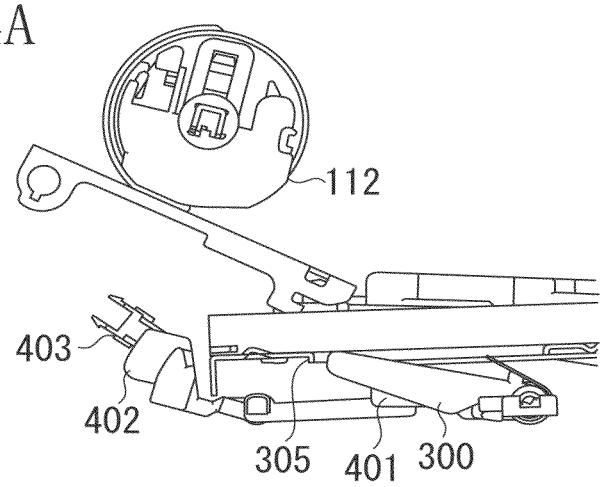
FIGS. 4A, 4B, and 4C are diagrams illustrating a sheet feeding operation by a sheet cassette 110 and a sheet feeding roller 112.
Figure 4B:
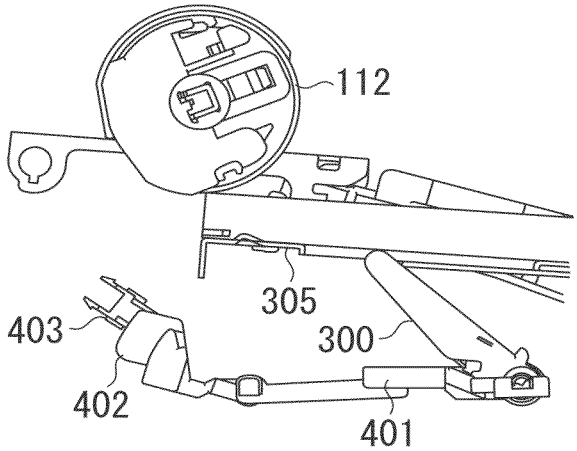
Figure 4C:
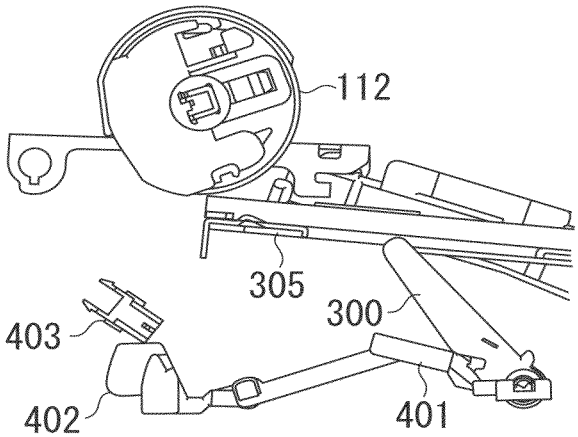

FIGS. 4A, 4B, and 4C illustrate the sheet feeding operation by the sheet cassette 110 and the sheet feeding roller 112. FIG. 4A illustrates a situation prior to the sheet feeding operation. FIG. 4B illustrates a sheet feeding operation with the recording materials loaded up to a substantially half level of the sheet cassette (hereinafter called medium loading). FIG. 4C illustrates a sheet feeding operation when few recording materials are loaded on the sheet cassette (hereinafter called low loading).

FIG. 4A illustrates a situation before the sheet feeding operation is started. The recording materials are loaded on the bottom plate 305. The loaded recording materials press down the recording material sensor lever 300.

Interlocking with the recording material sensor lever 300, a recording material sensor link 401 is actuated. When the recording material sensor link 401 is actuated, a recording material sensor flag 402 moves in between a light-emitting unit and a light-receiving unit of a photo interruptor 403 (light reflection type photo interruptor), so that the recording material sensor flag 402 interrupts light beam in the photointerruptor 403.

FIG. 4B illustrates a situation in which after the sheet feeding operation starts, the bottom plate 305 is raised so that the recording materials stacked up to a medium level come into contact with the sheet feeding roller 112.

Although the recording material sensor lever 300 is raised with the raise of the bottom plate 305, the recording material sensor link 401 and the recording material sensor flag 402 remain stopped at the same position as prior to the sheet feeding operation without interlocking with the recording material sensor lever 300. In the photointerruptor 403, the light beam remains interrupted by the recording material sensor flag 402.

FIG. 4C illustrates a situation in which after the sheet feeding operation starts, the bottom plate 305 is raised so that the recording materials loaded in a low quantity keep contact with the sheet feeding roller 112. Because the loading amount of the recording materials is smaller in the situation of FIG. 4C than that of FIG. 4B, as the recording material sensor lever 300 is raised with the raise of the bottom plate 305, the recording material sensor link 401 is moved.

Interlocking with the movement of the recording material sensor link 401, the recording material sensor flag 402 moves to a position where the photointerruptor 403 allows light beam to pass through.

According to a conventional art, in any case of the medium loading and the low loading of the recording materials, the recording material sensor flag 402 is configured to always interrupt light beam in the photointerruptor 403 during the sheet feeding operation as illustrated in FIG. 4B.

According to the present exemplary embodiment, the recording material sensor flag 402 is configured to move to the position where the photointerruptor 403 allows light beam to pass through during the sheet feeding operation when the recording materials is in the low loading. Consequently, the low loading of the recording materials can be detected.

A position where the light beam interruption state of the photointerruptor 403 changes to the light beam passing state thereof is determined by a height of the recording materials stacked on the sheet cassette 110. Preferably, the height of the stacked recording materials is about 30 sheets in case of, for example, 75-g plain paper.

Figure 5:
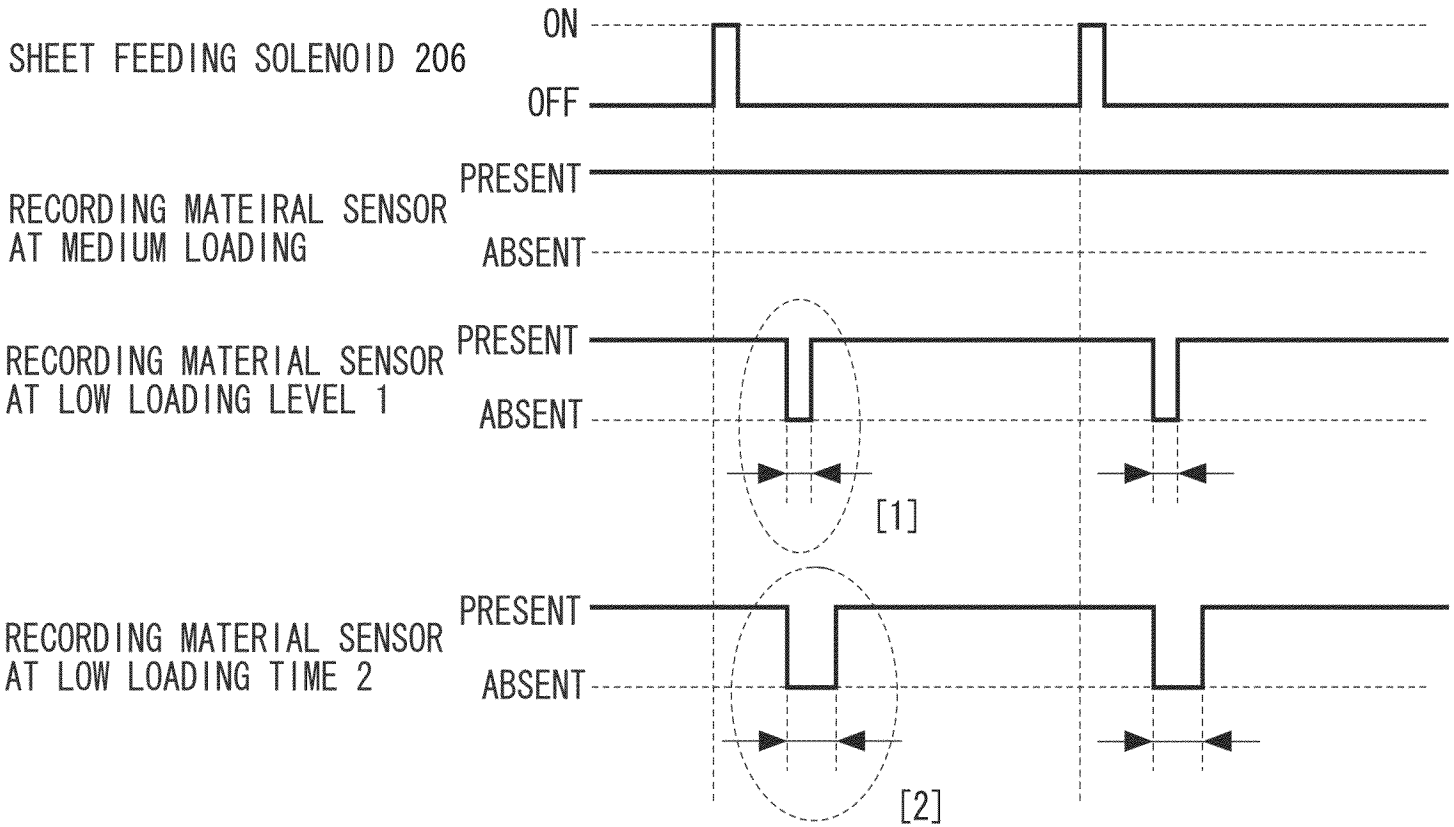
FIG. 5 is a timing chart illustrating outputs of a recording material sensor 111 when the stacking amounts of the recording materials stacked on the sheet cassette are different.

FIG. 5 is a timing chart illustrating outputs of the recording material sensor 111 when the stacking amounts of the recording materials stacked on the sheet cassette are different. As an example, the stacking amount of the recording materials is assumed to be arranged in a relationship of medium loading>low loading level 1>low loading level 2.

As a specific example, when the stacking amount when the recording materials are stacked fully is assumed to be 100%, the medium loading is set to 50%, the low loading level 1 is set to 10%, and the low loading level 2 is set to 5%. This setting is just an example and the stacking amounts for the low loading level 1 and the low loading level 2 may be set arbitrarily depending on a timing when the stacking amount of the recording materials should be detected.

FIG. 5 illustrates an action when two sheets of the recording materials are fed. With the medium loading of the recording materials, at a timing when the recording material sensor 111 turns ON the sheet feeding solenoid 206, the bottom plate 305 acting as the stacker portion for the recording materials rises.

Interlocking with a rise of the bottom plate 305, the recording material sensor lever 300 also rises. However, because the recording material sensor link 401 is not moved, light beam in the photointerruptor 403 is interrupted, so that existence of the recording materials continues to be detected.

When the recording materials are stacked at the low loading level 1, from the timing when the recording material sensor 111 turns ON the sheet feeding solenoid 206, the bottom plate 305 rises. Interlocking with a rise of the bottom plate 305, the recording material sensor lever 300 also rises to move the recording material sensor link 401.

As a result, the photointerruptor 403 turns into a state in which light beam passes through. Consequently, a period of time in which the recording material sensor 111 detects that no recording material exists is generated during a rise of the bottom plate 305 ([1] in FIG. 5).

When the recording materials are stacked at the low loading level 2, from the timing when the recording material sensor 111 turns ON the sheet feeding solenoid 206, the bottom plate 305 rises. The recording material sensor lever 300 also rises interlocking with the rise of the bottom plate 305 to move the recording material sensor link 401.

As a result, the photointerruptor 403 turns into a state in which light beam passes through. Consequently, a period of time in which the recording material sensor 111 detects that no recording material exists is generated during a rise of the bottom plate 305 ([2] in FIG. 5).

Because at the low loading level 2, the stacking amount of the recording materials is smaller than the low loading level 1, a period of time when the recording material sensor 111 detects that no recording material exists ([2] of FIG. 5) is longer than a period of time when it detects that no recording material exists at the time of low loading level ([1] of FIG. 5).

Thus, when the bottom plate 305 is raised, the amount of the recording materials stacked on the sheet cassette 110 can be detected based on a result of detection by the recording material sensor 111, i.e., a period of time when it is detected that no recording materials exist.

Figure 6:
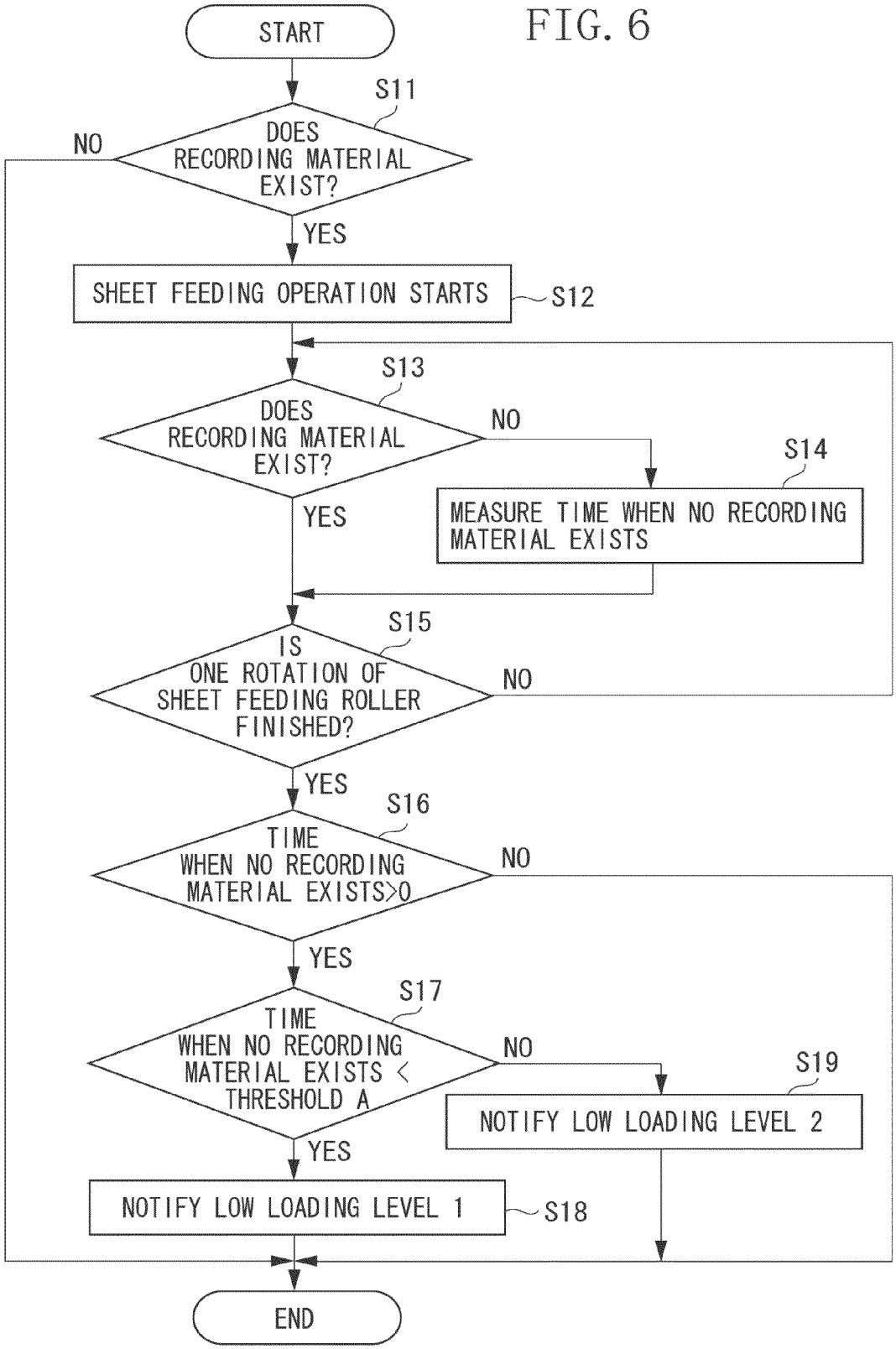
FIG. 6 is a flow chart illustrating an operation for detecting a remaining amount of the recording materials when executing the recording material feeding operation according to a first exemplary embodiment.

FIG. 6 is a flow chart for detecting a remaining amount of the recording materials when executing the recording material feeding operation. In step S11, the CPU 204 detects whether or not the recording materials exist by means of the recording material sensor 111. When it is detected that the recording materials exist (YES in step S11), in step S12, the CPU 204 starts the operation for feeding the recording material.

In step S13, in the sheet feeding operation, the CPU 204 detects whether or not the recording materials exist by means of the recording material sensor 111. If it is detected that no recording materials exist (NO), in step S14, the recording material sensor 111 measures a period of time when it is detected that no recording materials exist. In step S15, the CPU 204 detects whether or not the sheet feeding roller 112 makes one rotation.

After the CPU 204 determines that the sheet feeding roller 112 makes one rotation (YES in step 15), in step S16, the CPU 204 determines whether or not the period of time when it is detected that no recording materials exist is longer than 0. If the period of time when it is detected that no recording materials exist is 0 (NO in step S15), the CPU 204 determines that a sufficient amount of the recording materials is stacked on the sheet feeding cassette 110, and then terminates the processing.

If the period of time when it is detected that no recording material exists is longer than 0 (YES in step S16), in step S17, the CPU 204 determines whether or not the period of time when no recording material exists is shorter than a threshold A.

If the period of time when it is detected that no recording materials exist is shorter than the threshold A (YES in step S17), in step S18, the CPU 204 notifies that the recording materials are stacked at the low loading level 1. If the period of time when it is detected that no recording materials exist is longer than the threshold A, in step S19, the CPU 204 notifies that the recording materials are stacked at the low loading level 2.

The threshold A is desired to be set to satisfy the following equation.

$$\text{Threshold } A = T\max * (Ns/Nm) \quad (1)$$

Tmax: maximum period of time when it is detected that no recording materials exist by the recording material sensor 111 during a sheet feeding operation (i.e., a state in which a single recording material is loaded)

Ns: number of stacked sheets determined to be at the low loading level

Nm: maximum number of stacked sheets which can be determined to be at the low loading level.

Due to dispersion of manufacturing accuracy of the recording material sensor lever 300, the recording material sensor link 401, and the recording material sensor flag 402, and an error in installation of the photointerruptor 403, the light emitting element and the light receiving element in the photointerruptor 403, a timing when the photointerruptor turns from the light beam interruption state to the light beam passing state may be different depending on the image forming apparatuses.

Then, by feeding one reference paper for an initial measurement for determining the threshold A, a period of time (Tmax) when it is detected that no recording materials exist during the sheet feeding operation is measured. According to this measurement result, the threshold A is adjusted to detect the stacking amount of the recording materials more accurately.

According to the present exemplary embodiment, the processing for the recording material sensor 111 to determine whether or not the recording materials exist is executed until the sheet feeding roller 112 makes one rotation after the sheet feeding operation starts. However, this processing may be executed in a time interval from a rise of the bottom plate 305 to a down thereof during the sheet feeding operation.

Although two levels, e.g., the low loading level 1 and the low loading level 2 are set for determining whether or not the recording materials exist, it is permissible to set more levels to grasp the stacking amount more finely.

In the sheet feeding cassette 110 which raises and lowers the bottom plate 305 each time when feeding a recording material, the recording material sensor 111 detects that no recording materials exist when the bottom plate 305 rises over a predetermined position.

Thus, by measuring a period of time when it is detected that no recording materials exist during the sheet feeding operation, the stacking amount of the recording materials in the sheet feeding cassette 110 can be detected.

As a result, whether or not the recording materials exist on the sheet feeding cassette 110 and the stacking amount of the recording material can be detected accurately without using a flag having different transmittances, thereby improving usability of the recording material sensor.

According to the first exemplary embodiment described above, in the sheet feeding cassette 110 which raises and lowers the bottom plate 305 each time when feeding each paper, the recording material sensor 111 detects that no recording material exists when the bottom plate 305 rises over a predetermined position. Thus, the stacking amount of the recording materials is detected.

As a second exemplary embodiment, a method for detecting the number of recording materials stacked in the sheet feeding cassette according to the kind of the recording material will be described.

As described above in the first exemplary embodiment, the condition that the light beam interruption state of the photointerruptor 403 should change to the light beam passing state thereof is a height of the stacked recording materials. If the thickness of each recording material is different although the height of the stacked recording materials is equal, the number of the stacked recording materials is different.

For example, while the thickness of a 75 g plain paper is about 0.1 mm, the thickness of a 170 g thick paper is about 0.22 mm. That is, for example, a sheet feeding cassette 110 allowing papers to be loaded 30 mm high can be loaded with 30 sheets of the 75 g plain papers and 13 sheets of the 170 g thick papers.

In the present exemplary embodiment, a method for obtaining the number of stacked recording materials based on the height of the stacked recording materials and the kind of the recording materials will be described.

Figure 7:
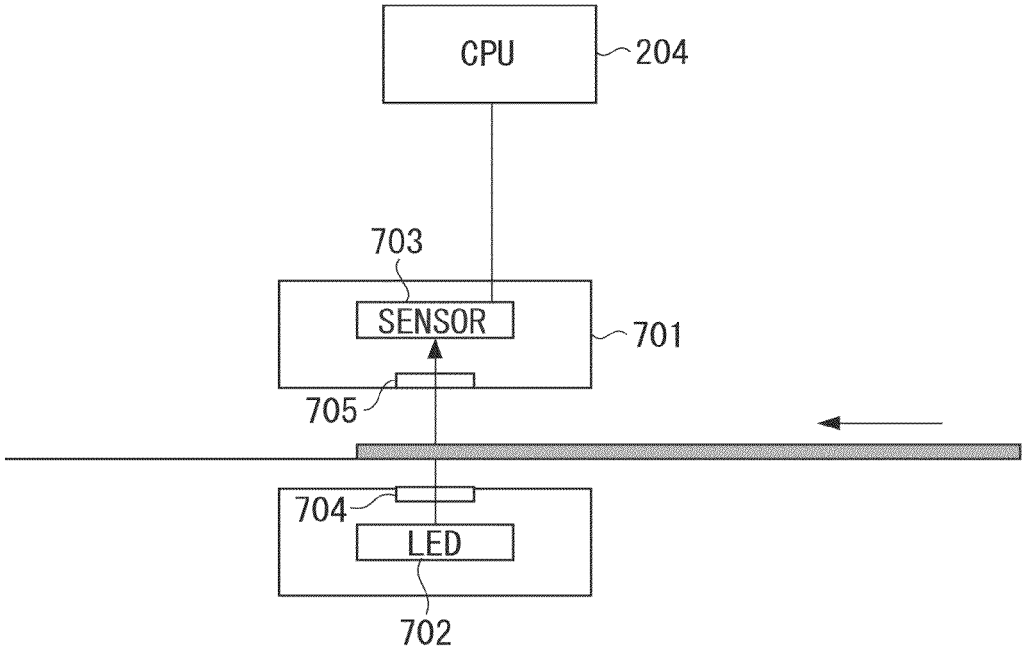
FIG. 7 is a schematic configuration diagram of the recording material detecting sensor for detecting the kind of the recording materials.

A recording material detection sensor 701 for detecting the kind of the recording material will be described with reference to FIG. 7. The recording material detection sensor 701 includes an LED 702, a light-receiving sensor 703, a lens 704, and a lens 705.

Light beam projected from the LED 702 passes through the lens 704 and a recording material. The light beam passing through the recording material is condensed by the lens 705, and reaches the light-receiving sensor 703. The light-receiving sensor 703 is connected to the CPU 204, and the CPU 204 determines the kind of the recording material based on the amount of transmitted light received by the light-receiving sensor 703.

The recording material detection sensor 701 is disposed in the upstream of the registration sensor 113 and starts detecting the kind of the recording material at a timing when the recording material reaches the registration sensor 113.

Table 1 illustrates a relationship between the amount of transmitted light received by the light-receiving sensor 703 and the kind of the recording material.

TABLE 1

| Amount of transmitted light | Kind of recording material |
|---|---|
| Less than threshold B | Thick paper |
| Threshold B or more to less than threshold C | Plain paper |
| Threshold C or more | Thin paper |

Here, the relationship between the threshold B and the threshold C is defined so that threshold B<threshold C. In the meantime, specific values of the threshold B and the threshold C can be determined based on the amount of light projected by the LED 702.

Because the amount of light attenuates more as the thickness of the recording material increases, the amount of transmitted light increases in order of thick paper, plain paper and thin paper. To discriminate these states, the relationship of threshold B<threshold C is applied.

The CPU 204 can identify the kind of the recording material to be thin paper, plain paper, or thick paper corresponding to the amount of transmitted light received by the light-receiving sensor 703.

Although as an example, a configuration for discriminating the kinds of the recording materials into three kinds, i.e., thin paper, plain paper, and thick paper is employed here, the present invention is not limited to this example. It is permissible to identify the kinds of the recording materials into more than three types by setting the thresholds more finely.

Figure 8:
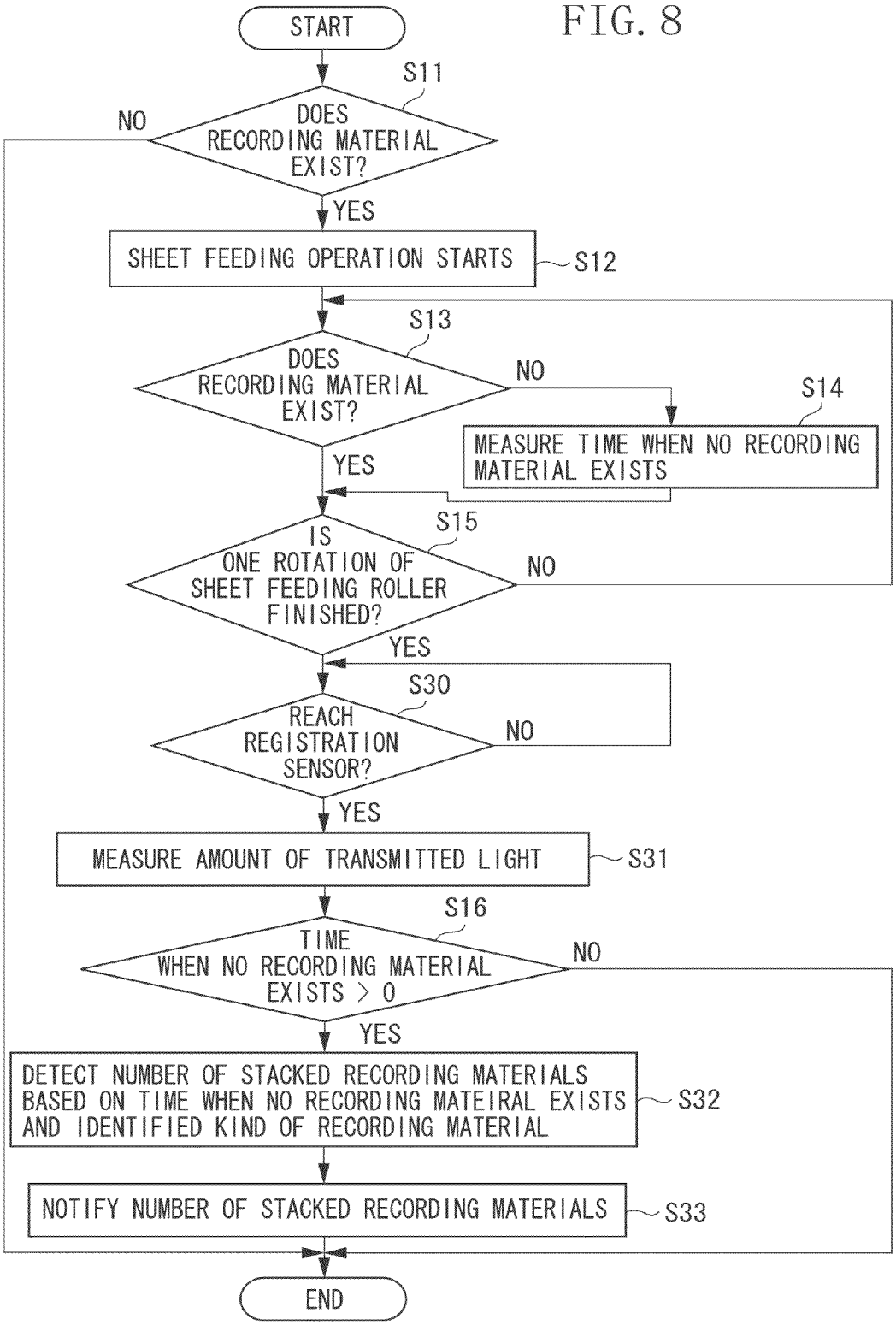
FIG. 8 is a flow chart illustrating an operation for detecting the remaining amount of the recording materials when executing the recording material feeding operation according to a second exemplary embodiment.

FIG. 8 is a flow chart for detecting the remaining amount of the recording material when executing the recording material feeding operation. Because step S11 to step S15 of this flowchart are similar to those of FIG. 6 of the first exemplary embodiment described above, description of those steps is omitted here.

In step S30, the CPU 204 detects whether the recording material reaches the registration sensor 113. When the recording material reaches the registration sensor 113 (YES in step S30), in step S31, the registration sensor 113 projects light beam to the recording material to measure the amount of transmitted light.

In step S16, the CPU 204 determines whether or not the period of time when it is detected that no recording material exists is longer than 0. When the period of time when it is detected that no recording material exists is 0 (NO in step S16), the CPU 204 determines that a sufficient amount of the recording materials are accumulated in the sheet feeding cassette 110 and terminates the processing.

If the period of time when it is detected that no recording materials exist is longer than 0 (YES in step S16), in step S32, the CPU 204 detects the number of stacked sheets based on the period of time when it is detected that no recording materials exist and the kind of the recording material identified as a result of the detection by the registration sensor 113. In step S33, the CPU 204 notifies the number of the stacked sheets.

Table 2 illustrates a relationship between the period of time when it is detected that no recording material exists and the number of stacked sheets based on the kind of the recording material.

TABLE 2

| Period of time when it is detected that no recording material exists | Thin paper | Plain paper | Thick paper |
|---|---|---|---|
| 0 | Not notified | Not notified | Not notified |
| Less than threshold A | Stacking number: 50 or less | Stacking amount: 30 or less | Stacking amount: 14 or less |
| Threshold A or more | Stacking number: 25 or less | Stacking number: 15 or less | Stacking number: 7 or less |

Although the above cases are classified depending on whether or not the period of time when it is detected that no recording materials exist exceeds the threshold A, the number of the stacked sheets may be detected finely by setting the thresholds more finely.

In the sheet feeding cassette 110 which raises and lowers the bottom plate 305 each time when one paper is fed, the recording material sensor 111 is configured to detect that no recording materials exist when the bottom plate 305 rises over a predetermined position.

Accordingly, measurement of the period of time when it is detected that no recording materials exist during the sheet feeding operation enables the stacking amount of the recording materials in the sheet feeding cassette 110 to be detected.

Therefore, whether or not the recording materials are stacked on the sheet feeding cassette 110 and the stacking amount of the recording materials can be detected accurately without using the flag having different transmittances, thereby improving the usability of the recording material sensor 111.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-247860 filed Nov. 4, 2010, which is hereby incorporated by reference herein in its entirety.

What is claimed is:

1. A recording material feeding apparatus comprising:

a feeding unit configured to feed a recording material;

a stacking unit configured to stack recording materials on a stacker portion thereof, lift up the stacker portion to feed the recording material using the feeding unit, and lift down the stacker portion after the recording material is fed by the feeding unit;

a detection unit configured to detect periods from a time when a detection value detected by the detection unit changes from a first value to a second value to a time when the detection value changes back to the first value during a period from a time when the stacker portion is lifted up to a position to feed the recording material from a lifted-down state and to a time when the stacker portion is lifted down from a lifted-up state, the periods being different in detection results; and a control unit configured to acquire a stacking amount of the recording materials stacked on the stacker portion based on the detection results of detection by the detection unit.

2. The recording material feeding apparatus according to claim 1, wherein the control unit determines that the stacking amount of the recording materials is decreased when the period from the time when the detection value detected by the detection unit is changed from the first value to the second value to the time when detection value changes back to the first value is longer than a predetermined period.

3. The recording material feeding apparatus according to claim 1, further comprising:

a recording material detection unit configured to detect the recording material by projecting light beam to the recording material;

wherein the control unit identifies the kind of the recording material based on a result of detection by the recording material detection unit, and obtains the stacking amount of the recording materials based on the kind of the recording material and the result of detection by the detection unit.

4. The recording material feeding apparatus according to claim 1, wherein, in a case where the stacking amount of the recording materials on the stacker portion is equal to or larger than a predetermined amount, the first value is maintained in the detection results.

5. An image forming apparatus comprising:

a feeding unit configured to feed a recording material;

a stacking unit configured to stack recording materials on a stacker portion thereof, lift up the stacker portion to feed the recording material using the feeding unit, and lift down the stacker portion after the recording material is fed by the feeding unit;

a detection unit configured to detect periods from a time when a detection value detected by the detection unit changes from a first value to a second value to a time when the detection value changes back to the first value during a period from a time when the stacker portion is lifted up to a position to feed the recording material from a lifted-down state and to a time when the stacker portion is lifted down from a lifted-up state, the periods being different in detection results; and a control unit configured to acquire a stacking amount of the recording materials stacked on the stacker portion based on the detection results of detection by the detection unit.

6. The image forming apparatus according to claim 5, wherein the control unit determines that the stacking amount of the recording materials is decreased when the period from the time when the detection value detected by the detection unit is changed from the first value to the second value to the time when detection value changes back to the first value is longer than a predetermined period.

7. The image forming apparatus according to claim 5, further comprising:

a recording material detection unit configured to detect the recording material by projecting light beam to the recording material, wherein the control unit identifies the kind of the recording material based on a result of detection by the recording material detection unit, and obtains the stacking amount of the recording materials based on the kind of the recording material and the result of detection by the detection unit.

8. The image forming apparatus according to claim 5, wherein, in a case where the stacking amount of the recording materials on the stacker portion is equal to or larger than a predetermined amount, the first value is maintained in the detection results.

9. A recording material feeding apparatus comprising:

a feeding unit configured to feed a recording material;

a stacking unit configured to stack recording materials on a stacker portion and lift up the stacker portion so that the feeding unit feeds the recording materials;

a detection unit configured to detect the position of the stacker portion; and a control unit configured to determine that a stacking amount of the recording materials stacked on the stacker portion is smaller than a predetermined amount in a case where a detection value changes from a first value to a second value in a result of detection by the detection unit when the stacker portion is lifted up to a position to feed the recording materials from a lifted-down state.

10. An image forming apparatus comprising:

a feeding unit configured to feed a recording material;

a stacking unit configured to stack recording materials on a stacker portion and lift up the stacker portion so that the feeding unit feeds the recording materials;

a detection unit configured to detect a position of the stacker portion; and a control unit configured to determine that a stacking amount of the recording materials stacked on the stacker portion is smaller than a predetermined amount in a case where a detection value changes from a first value to a second value in a result of detection by the detection unit when the stacker portion is lifted up to a position to feed the recording materials from a lifted-down state.

* * * * *